United States Patent [19]

Fatello

[11] Patent Number: 4,521,200

[45] Date of Patent: Jun. 4, 1985

[54] SURFBOARD TYPE BOAT CONVERTIBLE INTO SAILBOAT OR BUOY

[76] Inventor: Ubaldo Fatello, via Filangieri n. 14, 10128 Turin, Italy

[21] Appl. No.: 538,028

[22] Filed: Sep. 30, 1983

[30] Foreign Application Priority Data

Oct. 14, 1982 [IT] Italy ..... 53811/82[U]
Nov. 17, 1982 [IT] Italy ..... 53932/82[U]

[51] Int. Cl.[3] ..... B63H 16/08

[52] U.S. Cl. ..... 440/23; 114/39; 114/346; 441/67

[58] Field of Search ..... 114/39.1, 39.2, 346, 114/93; 440/23, 21; 441/67

[56] References Cited

U.S. PATENT DOCUMENTS

| | | | |
|---|---|---|---|
| 3,045,264 | 7/1962 | Smith | 441/67 |
| 3,371,636 | 3/1968 | Sharp | 114/39 |
| 3,585,952 | 6/1971 | Head | 114/39 |
| 3,971,330 | 7/1976 | French | 440/23 |

FOREIGN PATENT DOCUMENTS

| | | | |
|---|---|---|---|
| 2840505 | 3/1980 | Fed. Rep. of Germany | 440/23 |
| 3123967 | 1/1983 | Fed. Rep. of Germany | 114/39.2 |
| 2040827 | 9/1980 | United Kingdom | 441/67 |

*Primary Examiner*—Trygve M. Blix
*Assistant Examiner*—Thomas J. Brahan
*Attorney, Agent, or Firm*—Cullen, Sloman, Cantor, Grauer, Scott & Rutherford

[57] ABSTRACT

A surfboard type boat convertible into a sailboat or buoy and comprising a circular floating board enclosed by a shell of polyethylene and containing foamed polystyrene. A cone-shaped keel likewise filled with foamed polystyrene is provided on the lower side of the floating board. A hollow cylinder extends upwardly from and perpendicularly to the floating board and a piston provided with a handlebar at its upper end is slidably mounted within the cylinder. A water ejection tube extends transversely of the lower end of the cylinder through the cone-shaped keel. A rudder operable by the heels of the user of the boat is mounted downstream of the outlet of the water ejection tube. By lifting the piston water is sucked into the cylinder and by vigorously pushing down the piston the water is expelled through the ejection tube and the boat is propelled. The piston can be replaced by a mast for a sail without boom operable by the user. The cylinder can also be removed and the hole thus left be closed by a cover for converting the boat into a surfing buoy.

5 Claims, 9 Drawing Figures

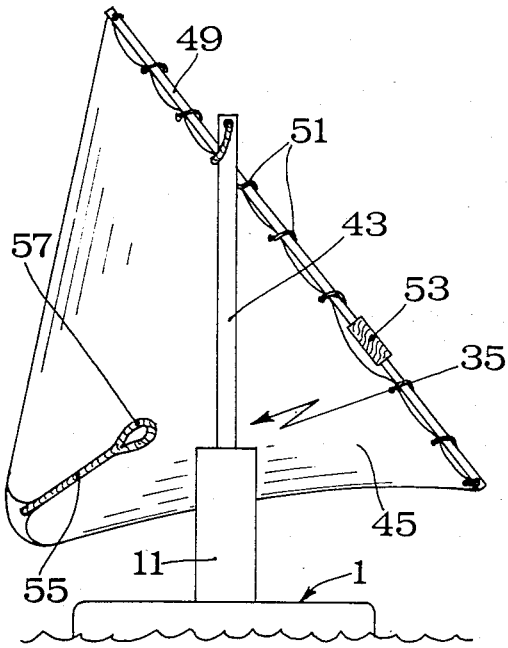
FIG. 5
FIG. 7
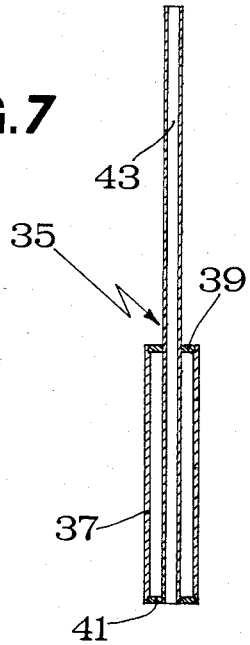
FIG. 9
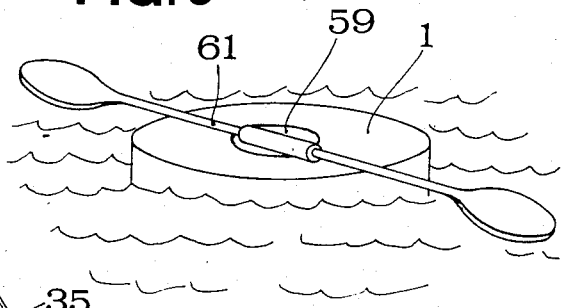
FIG. 6
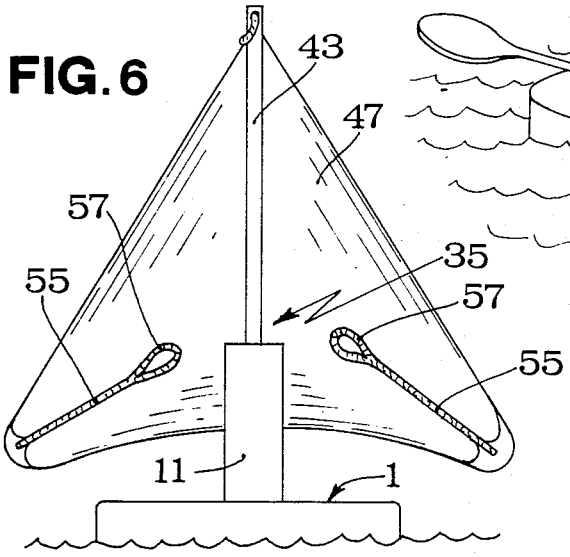
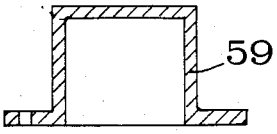
FIG. 8

SURFBOARD TYPE BOAT CONVERTIBLE INTO SAILBOAT OR BUOY

BACKGROUND OF THE INVENTION

This invention relates to a surfboard type boat adapted to be propelled by a water jet and convertible into a sailboard and/or a buoy.

The evolution of surfcraft goes through the same phases as that of boats which being born as rowboats have then become sailboats and finally motorboats driven by screws or a water jet. The boat according to the present invention marks a transition from the conventional surfboard equipped with a sail to a surfboard or boat driven by a water jet, which can be easily converted into a sailboat or buoy, if desired.

SUMMARY OF THE INVENTION

The present boat substantially comprises:

a floating board in the form of an annular disk formed of a shell of polyethylene or other plastics, preferably reinforced by fiber glass, containing therein an annular body of foamed polystyrene, said shell preventing the penetration of water into said disk and thus the latter from becoming too heavy;

a cone-shaped keel secured with its base portion to a seat on the floating board, said keel being likewise filled with foamed polystyrene in the mass of which there is provided a seat for the passage of an ejection tube of a propelling assembly;

a cylinder made of a tube of hard and polished plastic material and downwardly provided with a flange for securing said cylinder to said board and with a lateral tubular nozzle extending perpendicularly to the axis of said cylinder;

a piston made likewise of a tube of plastic material and closed at the bottom and provided near its lower end with at least two seats for accommodating O-rings of hard rubber of the piston ring type, said piston being upwardly provided with a handlebar formed of a bar extending perpendicularly through said cylinder and projecting laterally therefrom on both sides to permit it to be gripped by the user;

a rudder secured to said board to be operated by a control bar on the upper surface of said board, said control bar being operable by the heels of the user.

The present boat floats on the water surface on which it is placed in the manner of a buoy. Due to the foamed polystyrene or similar material with which both the board and the keel are filled, the water level reaches to about half the height of the board and fills the lower portion of the cylinder and the nozzle. When the user wishes to direct the boat in any desired direction or only wishes to move in that direction, he manually lifts the piston extending coaxially within the cylinder to allow the water to enter the cylinder and then expels it by vigorously pressing down the piston whereby the water is forced out of the nozzle to an extent sufficient to move the boat in the opposite direction due to the force of reaction exerted thereby. That direction can be satisfactorily corrected and controlled with the aid of the rudder arranged downstream of said nozzle and operable from the upper surface of the board.

According to a further feature of the present invention, which permits the present surfboard type boat driven by a water jet to be converted into another type of boat and more particularly into a sailing surfboard boat, the manually operable piston in the cylinder extending perpendicularly of the board may be replaced by a mast stub supporting a sail of the type appropriate for this type of surfboard and which can be steered by gripping it directly. This mast stub may be formed of a guide tube adapted to be inserted in the existing cylinder of the boat instead of the piston and made of plastic material such as polyethylene or the like. A pair of centrally apertured lids is secured to the upper and lower ends, respectively, of this mast stub and the actual mast, which is likewise formed of a tube of appropriate plastic material, glass fiber reinforced plastics or metal, is centered in the guide tube by said apertured lids which are secured, for example by welding, both peripherally to the guide tube and centrally to the actual mast.

According to a further feature of the present invention, which permits the present surfboard type boat driven by a water jet to be converted into a buoy type float, the cylinder containing the drive piston or mast stub may be replaced by a flanged cover flush with the upper surface of the surfboard and adapted to close the hole in the keel caused by the removal of said cylinder and the rudder may also be removed so that the boat becomes a buoy type surfboard or surfing buoy.

According to a further feature of the surfboard according to the invention, converted into sailboat, the sail used thereon is of the type shown on other kinds of sails, similar to those shown but without booms.

According to a further feature of the present invention, the sail supporting mast secured to the guide tube may be made in one piece or in two pieces to be able to reduce the overall dimensions thereof.

It is to be noted that with the surfboard according to the invention when it is used as a sailboat it is not necessary for the user to hold the sail but only to orient it by setting it at a desired angle with respect to the direction of the wind. This greatly facilitates and simplifies manoeuvering of the sail over the conventional sailing surfboards.

It is also to be noted that whereas in the conventional sailing surfboards a boom is indispensable because it is also used as a handlebar, and thus the use of a jib, genoa or spinnaker is precluded, in the surfboard of the present invention, when it is used as a sailboat, the use of the boom is precluded whereas sails with a free base are very well suited.

BRIEF DESCRIPTION OF THE DRAWINGS

FIG. 5 is a side elevational view of the portion of the boat that is visible above the water surface with the boat used as a sailboat equipped with a lateen type sail;

FIG. 6 is a side elevational view of the sailboat as in FIG. 5, but equipped with a gib type sail;

FIG. 7 is an enlarged axial section through the mast stub and mast;

FIG. 8 is an axial section through the cover used for converting the boat into a buoy; and FIG. 9 is a perspective view of the boat converted into a buoy.

DESCRIPTION OF PREFERRED EMBODIMENTS

Figure 1:
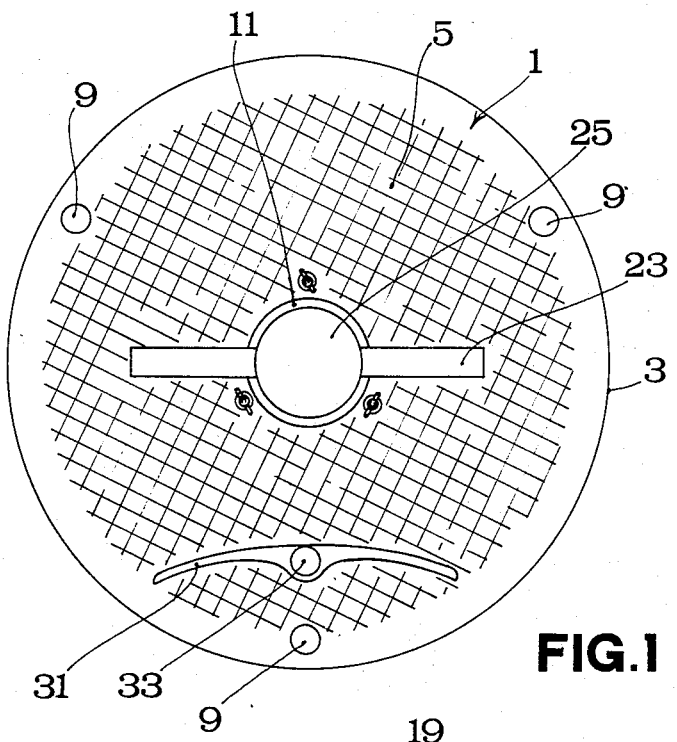
FIG. 1 is a top plan view of a surfboard type boat driven by a water jet according to the present invention.
Figure 2:
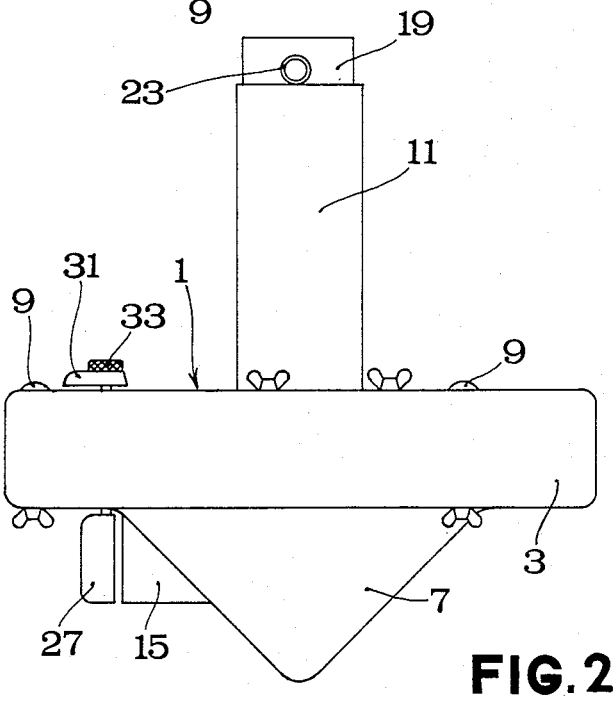
FIG. 2 is a side elevational view of the boat of FIG. 1.
Figure 3:
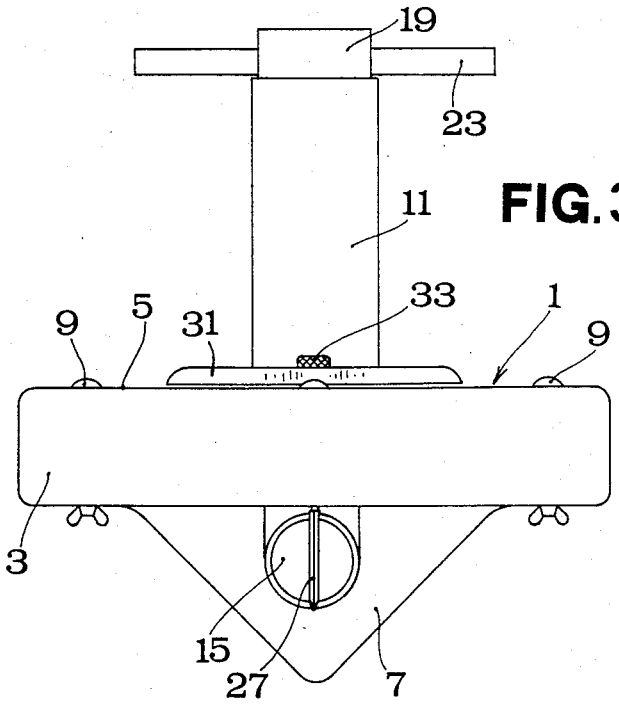
FIG. 3 is a side elevational view of the boat as in FIG. 2, but rotated through 90°.
Figure 4:
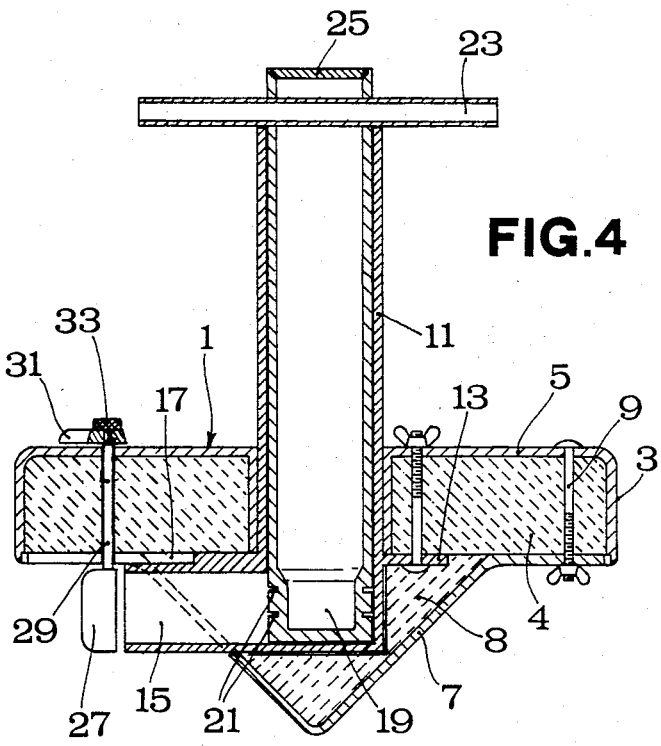
FIG. 4 is an axial section through the boat as shown in FIG. 2, but with the piston rotated through 90° relative to the cylinder.

As shown more particularly in FIG. 1, a surfboard boat according to the present invention substantially comprises a board 1 in the form of an annular disk or shell 3 of polyethylene or other plastics, preferably reinforced by fiber glass, containing in its interior an annular body 4 (FIG. 4) of foamed polystyrene adhesively connected to the shell 3. The shell 3 prevents the penetration of water into the annular body 4 and thus the latter from becoming too heavy. An upper surface 5 of the board 1 is partially or completely knurled for rendering it resistant to slipping.

The shell 3 is downwardly closed by a flanged cone 7 arranged in the manner of a cover with its apex extending downwardly. The cone 7 is likewise made of polyethylene and filled with foamed polystyrene 8 to facilitate floating of the overall assembly. The flanged cone 7 forms the keel of the boat. The keel 7 is secured to the board 1 by three bolts 9 of suitable material such as anticorodal, provided with wing nuts and extending through holes made in the flange of the keel and in the body of the board. The bolts have a thread of fine pitch such as MB or MC to prevent them from getting loose without using lock nuts.

A cylinder 11 made of hard and polished plastic material extends centrally through the board 1 perpendicularly to its plane surfaces. The cylinder 11 is downwardly provided with a flange 13 for connection to the board 1 and with a lateral tubular nozzle 15. In the described and illustrated embodiment the cylinder 11 has an inside diameter of 20 cm whereas the inside diameter of the lateral tube or nozzle 15 is about 14 cm and its length about 20 cm so that the nozzle coincides with the central edge of the keel and projects therefrom through a U-shaped recess 17 provided for this purpose in the keel 7 with its rounded portion extending downwardly. After the cylinder 11 has been secured to the board 1, it projects upwardly therefrom by about 50 cm.

A piston 19 likewise made of a tube of plastic material is mounted in the cylinder 11. The piston 19 has a closed bottom and an outside diameter of about 19.6 cm so that it can slide axially within the cylinder 11 without rubbing thereon. A pair of O-rings of hard rubber is received in seats 21 near the bottom of the piston 19 to ensure its sealing relative to the inner surface of the cylinder 11. An appropriate lubricant facilitates sliding of the piston 19 in the cylinder 1.

A handlebar 23 extends transversely through the top of the piston 19 and is adhesively connected thereto. The handlebar 23 is made of a simple tube of hard plastic material. The interior of the piston 19 is empty and a cover 25 of plastics material is adhesively connected to its upper edge. So even if the piston should inadvertently be pulled out of the cylinder and fall into the water, it will float and can easily be recovered.

A rudder 27 is secured to the board 1 downstream of the ejector nozzle 15 and is provided with a stem 29 having a square head with a threaded bore. The rudder 27 is formed of a blade of hard plastic material. A control bar 31 formed of a curved transversely extending rod is mounted at the upper end of the stem 29 of the rudder 27 above the upper surface of the board 1 and can be operated by the heels of the user. A threaded knob 33 having a knurled peripheral outer edge is used for connecting the control bar 31 to the stem 29 of the rudder. Also in this case the knob 33 is provided with screw threads of fine pitch to prevent it from loosening.

Once the cylinder 11 is mounted on the board 1 it projects upwardly from the outer surface thereof by about 50 cm to permit it to be easily gripped by the user and facilitate actuation of the piston 19 inserted therein. Thus, the propulsion system of the boat uses water jets expelled by the piston and reproduces the mode of locomotion of the octopuses, this propulsion system consisting in slowly sucking in the water into the cylinder 11 and then rapidly expelling it through the nozzle 15. The force of reaction opposing the water jet imparts movement to the boat at a speed which is in proportion to the power imparted to the water jet and thus virtually to the muscular strength of the user.

Calculations made by the present Applicant, which are omitted here for reasons of brevity, have shown that assuming that the user exerts a downward thrust on the piston of 40 kg, which would result in the water being forced out of the cylinder through the ejector nozzle in about 2 seconds, an outflow speed of about 0.5 m/sec. is obtained.

It is obvious that the dimensions given by way of example in the foregoing description of the preferred embodiment may vary within very wide limits. For example, the piston stroke may vary from a few millimeters up to a distance in which the piston is almost completely pulled out of the cylinder. Also the diameter of the cylinder may vary widely according to the various criteria of design.

FIG. 7 shows a mast 35 which can be mounted within the cylinder 11 instead of the piston 19 for converting the surfboard type boat driven by a water jet, as described above, into a sailboat. The mast 35 is mounted in a mast stub 37 formed by a hollow cylinder closed at its upper and lower ends by a pair of centrally apertured lids 39 and 41, respectively. The cylinder 37 is made of suitable plastic material such as polyethylene or the like. The lids 39 and 41 are likewise made of suitable plastic material or the like.

The actual mast 43 is centrally retained in the cylinder 37 by the lids 39 and 41 and is made of a tube of appropriate length and material such as polyethylene or other, possibly reinforced, synthetic resin or metal, taking into consideration its considerable length and bending strength that it must have.

Secured to the mast 43 is the sail which obviously must be without boom or lower sail fixing rod. The sail may be of the lateen type as shown at 45 in FIG. 5 or of the jib type as shown at 47 in FIG. 6. Other types of suitable sails such as a genoa (inflated jib) or spinnaker (ballon jib) are not shown in the drawings.

FIG. 5 shows the cylinder 11 from which projects the mast 43 to which the lateen type sail 45 is secured. The sail 45 has peak points 51 for tying it to a gaff 49 which is secured to the top of the mast 43. The gaff 49 is provided with a handgrip 53 and the lateen is provided with a lower cord or sheet 55 having a thimble 57 at its free end. For maneuvering the sail the gaff 49 is gripped by the handgrip 53 and the sheet 55 by the thimble 57.

FIG. 6 shows a jib type sail 47 mounted by means of the cylinder 11 on the boat 1 of the present invention. In this case the sail is maneuvered by the sheets 55.

From the foregoing explanations it will be apparent that the sail can only assume three positions as usually, namely: slack, when the sail is set lengthwise to the wind; close-reaching and broad reaching when the sail is set crosswise to the wind; wind on the quarter or from astern when the sail is placed broadside to the wind.

FIGS. 8 and 9 show how the boat according to the invention is converted into a buoy or surfing buoy. After the propelling cylinder 11 and the rudder have been removed from the boat of FIG. 1, the hole remaining thereafter is closed by a cover 59 shown in FIG. 8, this cover being inserted flush with the upper surface 5 of the board 1. Thus, the boat has been converted into a buoy or surfing buoy which can be propelled by oars or a paddle 61 and which may be used for sunbathing, for example, with the aid of a mat.

Obviously the invention is not limited to the described and illustrated embodiment and numerous changes and improvements obvious to one skilled in the art may be made therein without departing from the scope of the invention as defined by the appended claims. For example, an obvious modification would be to convert the water jet driven surfing boat into a sailboat not by the replacement of the piston 19 by a mast, but by replacing the entire cylinder 11 by such mast which would be accordingly dimensioned and designed. In this case obviously the mast would have to be provided at its bottom portion with flanges as on the cylinder 11 for securing it to the board 1.

I claim:

1. A surfboard type boat convertible into a sailboat or buoy, comprising:

a floating board in the form of an annular disk formed of a shell of plastic material;

an annular body of foamed plastic material contained therein, said shell preventing the penetration of water into said disk;

a cone-shaped keel having an annular base flange extending to the edge of said shell and secured thereto;

a foam plastic material filling said keel and defining an ejector tube seat;

a propelling assembly including a cylinder extending through and upwardly from and perpendicularly of said floating board;

a flange on said cylinder for securing said cylinder to said floating board and a lateral tubular nozzle at one end of said cylinder forming an ejection tube;

said nozzle extending perpendicular to the axis of said cylinder and support within said keel seat;

said cylinder being a tube of hard and polished plastic material;

a propelling piston slidably mounted and sealed within said cylinder and made of a tube of plastic material;

said piston being closed at the bottom;

a handle bar extending perpendicularly through said piston at its upper end and projecting laterally therefrom on both sides permit it to be gripped by the user;

a rudder underlying and secured to said floating board downstream of said nozzle;

and a transverse control bar located on the upper surface of said floating board connected to said rudder, said control bar being operable by the users heels.

2. A surfboard type boat as claimed in claim 1, wherein said boat is convertible into a surfing buoy by removing from said floating board said cylinder and said propelling piston as well as said rudder, the removal of said cylinder from said floating board leaving therein a hole adapted to be closed by a flanged cover flush with the upper surface of said floating board.

3. A surfboard type boat convertible into a sailboat or buoy, comprising:

a floating board in the form of an annular disk formed of a shell of plastics;

annular body of foamed plastics contained therein;

said shell preventing the penetration of water into said disc;

cone shaped keel having a base portion secured to a receiving seat on said floating board, a foamed plastic filling said keel and defining an ejector tube seat;

a propelling assembly including a cylinder extending upwardly from and perpendicularly to said floating board;

a flange on said cylinder for securing said cylinder to said floating board, and a lateral tubular nozzle at one end of the cylinder forming an ejection tube, said nozzle extending perpendicularly to the axis of said cylinder and supported within said keel seat;

said cylinder being a tube of hard and polished plastic material;

a propelling piston slidably mounted and sealed within said cylinder and made of a tube of plastic material, said piston being closed at the bottom;

a handle bar extending perpendicularly through said piston at its upper end and projecting laterally therefrom on both sides to permit it to be gripped by the user;

a rudder underlying and secured to said floating board downstream of said nozzle;

a transverse control bar located on the upper surface of said floating board connected to said rudder, said control bar being operable by the users heels;

said boat being convertible into a sailboat by removing said propelling piston from said cylinder and replacing it by a mast stub formed of a hollow cylinder of plastic material, and inserting in said mast stub a mast made of plastic material and held centrally in said mast stub by centrally apertured lids secured peripherally to said mast stub and centrally to said mast said mast supporting a sail operable by gripping it directly.

4. A surfboard type boat as claimed in claim 3, wherein said mast held centrally in said mast stub is made in one piece.

5. A surfboard type as claimed in claim 3, wherein said mast held centrally in said mast stub is made in two pieces so as to be able to reduce its length where necessary.

* * * * *